US008414165B2

(12) United States Patent
Zeng

(10) Patent No.: US 8,414,165 B2
(45) Date of Patent: Apr. 9, 2013

(54) HEAT DISSIPATION MECHANISM FOR LED LAMP

(75) Inventor: Xiao-Zhen Zeng, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 149 days.

(21) Appl. No.: 13/104,982

(22) Filed: May 11, 2011

(65) Prior Publication Data

US 2012/0287642 A1 Nov. 15, 2012

(51) Int. Cl.
*F21V 29/00* (2006.01)

(52) U.S. Cl.
USPC ..... 362/373; 313/46; 362/248; 362/249.02; 362/294; 362/356

(58) Field of Classification Search ..... 313/46; 362/248, 249.02, 294, 351, 356, 373, 545, 362/547, 800
See application file for complete search history.

(56) References Cited

U.S. PATENT DOCUMENTS

2007/0159827 A1* 7/2007 Huang ..... 362/294
2009/0027889 A1* 1/2009 Kang et al. ..... 362/294
2011/0090686 A1* 4/2011 Pickard ..... 362/249.02

* cited by examiner

*Primary Examiner* — Stephen F Husar

(57) ABSTRACT

A heat dissipation mechanism for LED lamp includes an LED module, a lamp holder, a thermal module, a heat transfer member, and a lamp shade. The thermal module includes a heat sink and a fan; the fan is connected at one side to the heat sink and at another side to the lamp holder. The heat transfer member is arranged between the LED module and the heat sink. The lamp shade has an open end connected to an outer periphery of the lamp holder; and the LED module, the thermal module, and the heat transfer member are received in a space defined in the lamp shade. The heat transfer member absorbs heat generated by the LED module and uniformly spreads the absorbed heat to the heat sink for dissipating into ambient air, so that an excellent heat dissipation effect can be achieved.

11 Claims, 3 Drawing Sheets

HEAT DISSIPATION MECHANISM FOR LED LAMP

FIELD OF THE INVENTION

The present invention relates to an LED lamp, and more particularly to a heat dissipation mechanism for LED lamp that provides excellent heat dissipation effect.

BACKGROUND OF THE INVENTION

Due to the constantly progress in the techniques for manufacturing light emitting diode (LED) and the increasing issues in environmental protection and energy saving, people have begun to widely use LED in a variety of illumination applications, such as LED vehicle lights, LED street lamps, LED table lamps, and other LED lamps.

A high-power LED would generate a relatively high amount of heat source during the operation thereof. The generated heat source must be efficiently removed from the product using the LED, lest the heat should accumulate in the product to cause risen temperature particularly at positions near the LED. In a worse condition, the accumulated heat would adversely affect the normal operation and service life of the whole product or some components thereof.

The conventional LED lamp is not provided with a heat dissipation mechanism to remove the heat generated by the LED thereof. When the LED lamp is lightened over a long period of time, the heat generated by the LED would accumulate in the LED lamp and could not be effectively removed therefrom, bringing the LED to burn out due to overheat. To solve the above problem and dissipate the heat accumulated in the LED lamp, there was developed a heat dissipation mechanism for LED lamp as shown in FIG. 1.

Please refer to FIG. 1. The conventional heat dissipation mechanism for LED lamp includes a lamp shade 10, an LED module 11, a heat sink 12, and a lamp holder 14. The lamp shade 10 has a first open end 101 and an opposite second open end 102, and internally defines a hollow receiving space 104 between and communicating with the first and the second open end 101, 102 for receiving the LED module 11 and the heat sink 12 therein.

The heat sink 12 is located between the LED module 11 and the lamp holder 14, and includes a main body 121 and a plurality of radiating fins 123. The main body 121 of the heat sink 12 has a plurality of mounting sections 124 outward extended from an outer periphery of the main body 121, and each of the mounting sections 124 is provided at a free end with a through hole 125. The radiating fins 123 are spaced along the outer periphery of the main body 121 and located between adjacent mounting sections 124. The main body 121 and the radiating fins 123 of the heat sink 12 have one side bearing on the LED module 11, and an opposite side bearing on and connected to the lamp holder 14.

The lamp holder 14 has a main body 141, a plurality of support arms 142, and a third open end 143 facing toward the heat sink 12. The main body 141 of the lamp holder 14 is located in the third open end 143, and the support arms 142 are spaced along and extended from an outer periphery of the main body 141 to the third open end 143 of the lamp holder 14, such that an opening 145 is formed between any two adjacent support arms 142 to communicate with the third open end 143. A mounting hole 146 is formed at each of the joints of the support arms 142 and the third open end 143. A plurality of screws (not shown) are extended through the through holes 125 on the heat sink 12 and the mounting holes 146 on the lamp holder 14 to lock the heat sink 12 to the lamp holder 14, and then, the lamp shade 10 is connected at the second open end 102 to an outer periphery of the lamp holder 14 to complete the conventional heat dissipation mechanism for LED lamp.

When the LED module 11 emits light and generates a high amount of heat, the generated heat is absorbed by the main body 121 and the radiating fins 123 of the heat sink 12, so that the absorbed heat is radiated from the radiating fins 123 to dissipate into ambient air to achieve the effect of removing heat from the LED module 11.

While the conventional heat dissipation mechanism for LED lamp as described with reference to FIG. 1 is able to dissipate the heat generated by the LED module 11 into ambient air, the heat dissipation effect is relatively low because there is only a very small contact surface between the LED module 11 and the main body 121 and the radiating fins 123 of the heat sink 12. Further, the heat sink 12 has poor ability of uniformly spreading heat over a large area. As a result, the heat absorbed by the main body 121 and the radiating fins 123 of the heat sink 12 could not be quickly and uniformly spread to all the radiating fins 123 and radiated into ambient air, and contact areas between the radiating fins 123 and the LED module 11 and the main body 121 of the heat sink 12 tend to have highly raised temperature, bringing the LED module 11 to become locally overheated. This condition would adversely affect an overall illuminance and shorten the service life of the LED lamp. In some worse conditions, the LED module 11 would burn out and become damaged.

In brief, the conventional heat dissipation mechanism for LED lamp has the following disadvantages: (1) providing poor heat dissipation effect; (2) causing lowered illuminance of the LED lamp; and (3) shortening the service life of the LED module.

It is therefore tried by the inventor to develop an improved heat dissipation mechanism for LED lamp, so as to eliminate the drawbacks in the prior art.

SUMMARY OF THE INVENTION

A primary object of the present invention is to provide a heat dissipation mechanism for LED lamp capable of uniformly spreading a heat source to a heat sink via a heat transfer member, so as to achieve excellent heat dissipation effect.

Another object of the present invention is to provide a heat dissipation mechanism for LED lamp, so as to increase the illuminance and extend the service life of an LED module for an LED lamp.

To achieve the above and other objects, the heat dissipation mechanism for LED lamp according to the present invention includes an LED module; a lamp shade having a first open end and an opposite second open end, and internally defining a hollow receiving space communicable with the first and the second open end; a thermal module including a heat sink and a fan connected to the heat sink; a heat transfer member being arranged between the heat sink and the LED module, and having a heat-receiving face oriented to and bearing on the LED module and an opposite heat-transfer face oriented and connected to one side of the heat sink opposite to the fan; and a lamp holder having an open end connected to one side of the fan opposite to the heat sink; the lamp shade being connected at the second open end to an outer periphery of the lamp holder; and the LED module, the thermal module and the heat transfer member being received in the hollow receiving space of the lamp shade. By including the heat transfer member in the heat dissipation mechanism for LED lamp according to the present invention, it is able to effectively increase the illuminance of the LED lamp and achieve excellent heat dissipation effect at the same time.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with a preferred embodiment thereof and with reference to the accompanying drawings.

Figure 1:
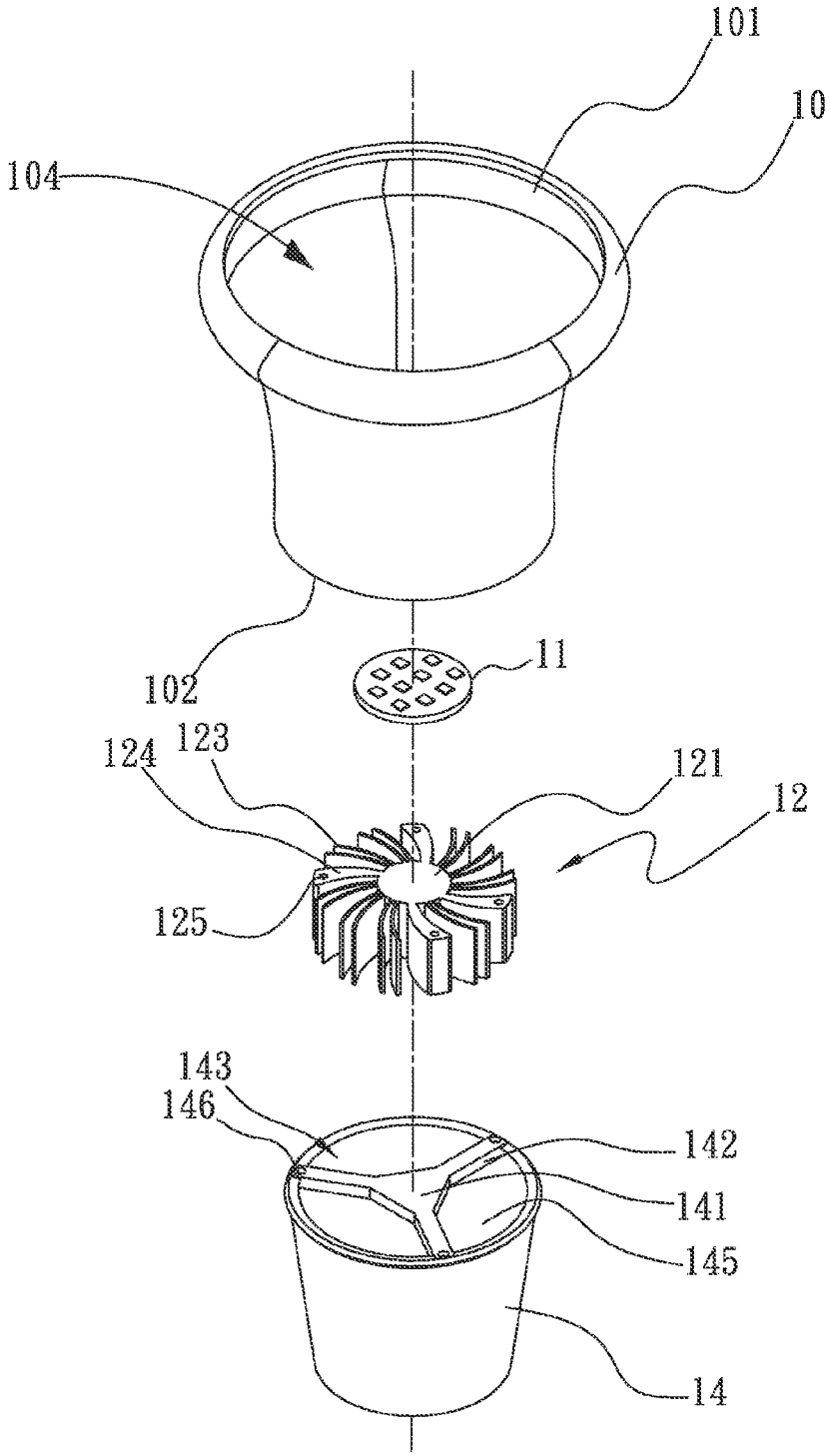
Fig. 1(PRIOR ART)
FIG. 1 is an exploded perspective view of a conventional heat dissipation mechanism for LED lamp.
Figure 2:
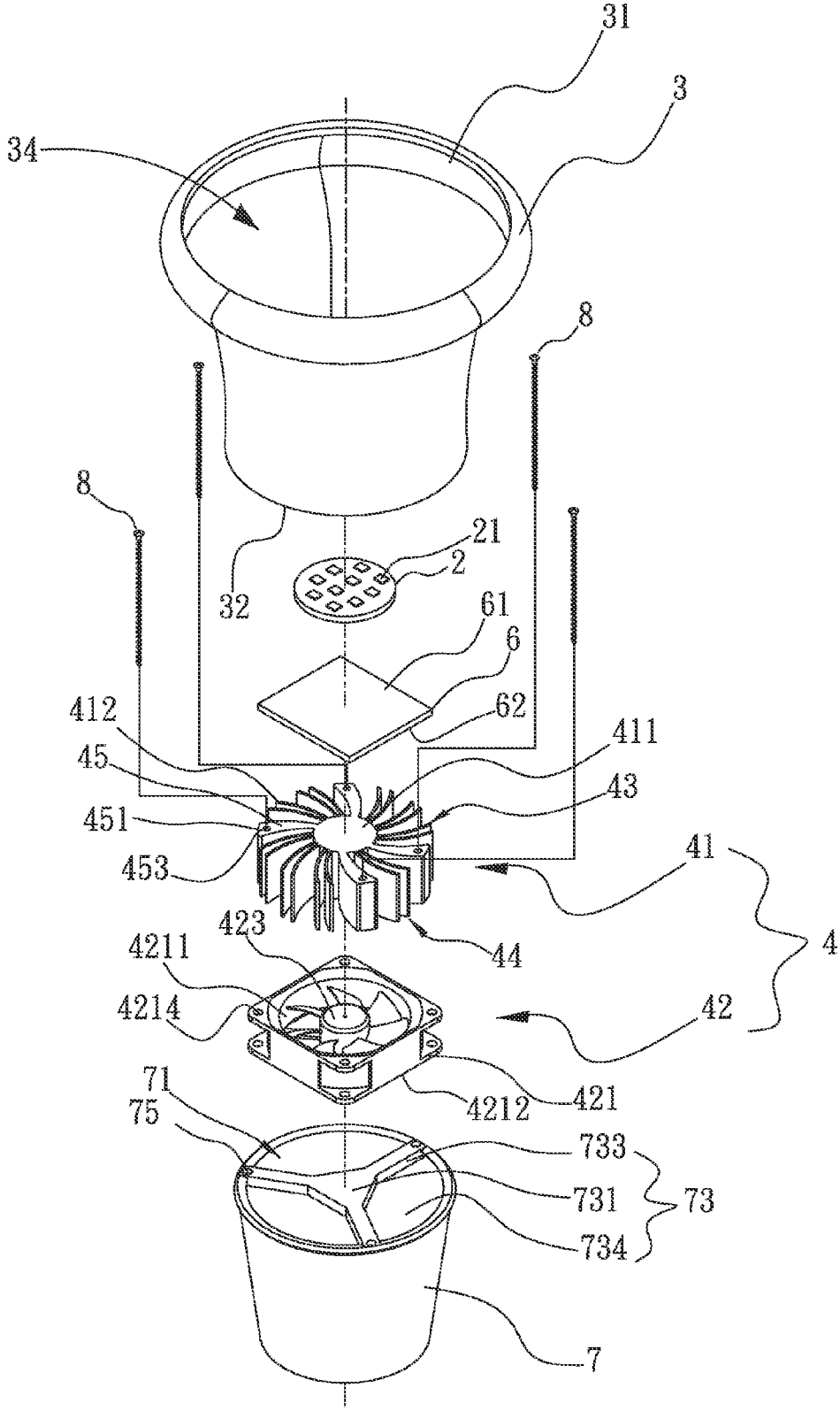
FIG. 2 is an exploded perspective view of a heat dissipation mechanism for LED lamp according to a preferred embodiment of the present invention.
Figure 3:
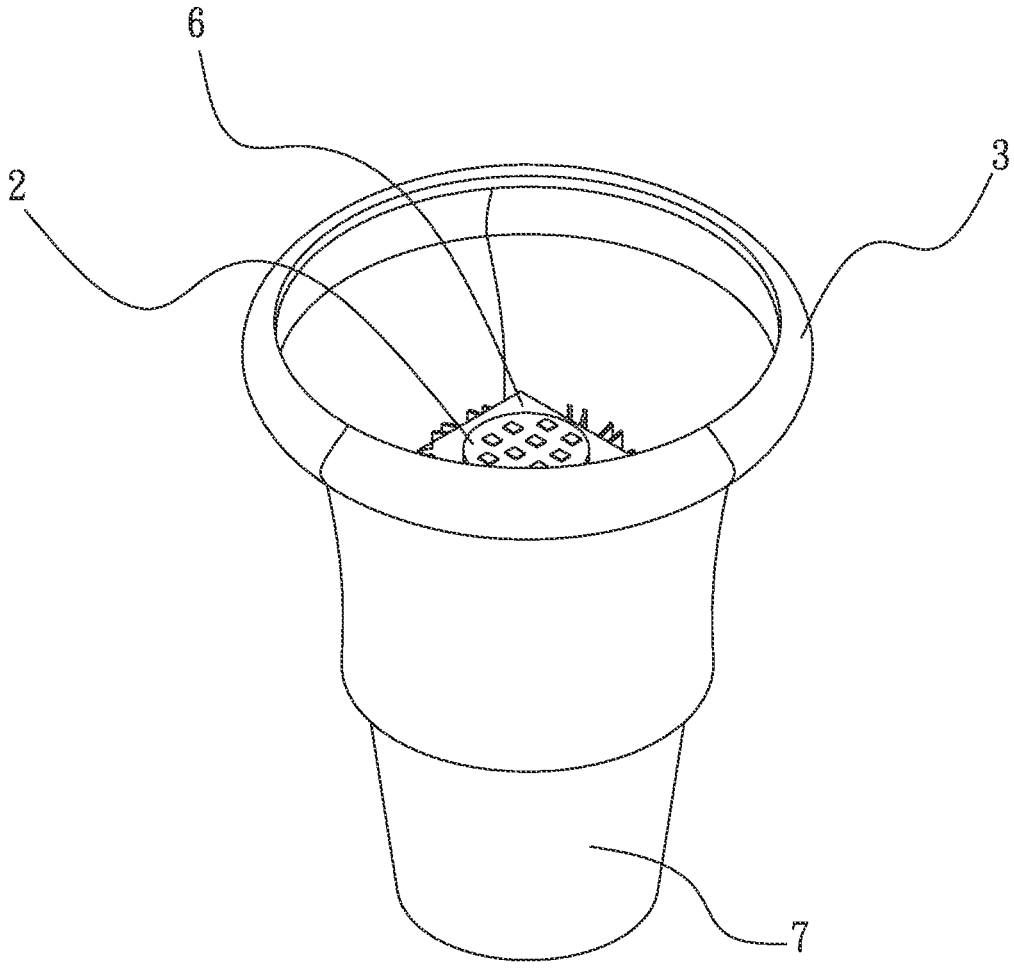
FIG. 3 is an assembled view of FIG. 2.

Please refer to FIGS. 2 and 3 that are exploded and assembled perspective views, respectively, of a heat dissipation mechanism for LED lamp according to a preferred embodiment of the present invention. As shown, the present invention includes an LED module 2, a lamp shade 3, a thermal module 4, a heat transfer member 6, and a lamp holder 7. The lamp shade 3 has a first open end 31 and an opposite second open end 32, and internally defines a hollow receiving space 34 between and communicable with the first and the second open end 31, 32. The LED module 2, the thermal module 4 and the heat transfer member 6 are received in the hollow receiving space 34. The LED module 2 includes an array of spaced LED chips 21.

The thermal module 4 includes a heat sink 41 and a fan 42 aligned with and connected to the heat sink 41. The fan 42 has a frame 421 and a blade assembly 423 mounted in the frame 421. The frame 421 has an air-out side 4211, an opposite air-in side 4212, and a plurality of mounting holes 4214. The air-out side 4211 is oriented to the heat sink 41, and the air-in side 4212 is fixedly connected to an end of the lamp holder 7. The plurality of mounting holes 4214 are formed at and extended through four corners of the frame 421 in a thickness direction thereof.

As can be seen in FIGS. 2 and 3, the heat sink 41 has a main body 411, a plurality of radiating fins 412, a heat-absorption section 43, and a heat-dissipation section 44. The heat-absorption section 43 is formed at one side of the heat sink 41 facing toward the LED module 2, and the heat-dissipation section 44 is formed at an opposite side of the heat sink 41 facing toward the air-out side 4211 of the fan 42.

The main body 411 of the heat sink 41 includes a plurality of mounting sections 45, which are outward extended from an outer periphery of the main body 411 and are spaced from one another. The mounting sections 45 respectively have a free end 451, on which a through hole 453 is provided corresponding to the mounting holes 4214 on the frame 421 of the fan 42 for corresponding fastening elements 8 to extend therethrough. In the illustrated preferred embodiment, the fastening elements 8 are screws without being limited thereto. For example, the fastening elements 8 may be otherwise insertion pins. The radiating fins 412 are outward extended from and spaced along the outer periphery of the main body 411 to locate between adjacent mounting sections 45.

The heat transfer member 6 is a vapor chamber and is arranged between the heat sink 41 and the LED module 2. The heat transfer member 6 has a heat-receiving face 61 bearing on the LED module 2, and an opposite heat-transfer face 62 connected to one side of the heat sink 41, i.e. in tight contact with the heat-absorption section 43 of the heat sink 41. In the illustrated preferred embodiment, the heat transfer member 6 is fixedly connected to the heat sink 41 by way of welding.

Since the heat transfer member 6 in the form of a vapor chamber enables two-dimensional heat dissipation, heat generated by the LED module 2 and absorbed by the heat-receiving face 61 can be quickly and uniformly distributed over the heat-transfer face 62. The heat-absorption section 43 of the heat sink 41 would receive and guide the heat from the heat-transfer face 62 of the heat transfer member 6 to the radiating fins 412 at the heat-dissipation section 44 for dissipating into ambient environment. Meanwhile, the fan 42 would guide air through the air-out side 4211 to the heat sink 41 to forcedly carry the heat away from the radiating fins 412. The heat transfer member 6 not only provides an increased contact surface with the heat sink 41, i.e. an increased heat transfer area between the LED module 2 and the heat sink 41, but also quickly and uniformly guides the heat source to the heat sink 41 for dissipation. Thus, the problem of locally overheated area on the heat sink caused by the LED module as found in the conventional LED lamp heat dissipation mechanism can be effectively improved to achieve excellent heat dissipation effect.

Please refer to FIG. 2. The lamp holder 7 has a third open end 71 facing toward the air-in side 4212 of the fan 42, and a mounting section 73 arranged in the third open end 71. The mounting section 73 includes a main body 731 and a plurality of support arms 733 outward extended from the main body 731 to the third open end 71 of the lamp holder 7. The support arms 733 are spaced from one another to define a plurality of openings 734 between them. The openings 734 are communicable with the third open end 71.

A plurality of mounting holes 75 is provided at joints of the support arms 733 and the third open end 71 of the lamp holder 7 to correspond to the mounting holes 4214 on the frame 421 of the fan 42. The fastening elements 8 can be sequentially extended through the through holes 453 on the heat sink 41 and the mounting holes 4214 on the fan 42 into the mounting holes 75 on the lamp holder 7, so as to lock the LED module 2, the thermal module 4, and the heat transfer member 6 to the main body 731 and the support arms 733 of the lamp holder 7. Thereafter, the lamp shade 3 can be connected at the second open end 32 to an outer periphery of the lamp holder 7 to complete the heat dissipation mechanism for LED lamp according to the present invention.

In the present invention, by arranging the heat transfer member 6 between the LED module 2 and the thermal module 4, and connecting the thermal module 4, the lamp shade 3 and the lamp holder 7 to one another to form an integral unit, it is able to achieve excellent heat dissipation effect, effectively increase an overall illuminance of the LED lamp, and extend the service life of the LED module 2.

Accordingly, the present invention is superior to the prior art for the following advantages: (1) providing excellent heat dissipation effect; (2) increasing an overall illuminance of the LED lamp; and (3) extending the service life of the LED module.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A heat dissipation mechanism for LED lamp, comprising:

an LED module;

a lamp shade having a first open end and an opposite second open end, and internally defining a hollow receiving space communicable with the first and the second open end;

a thermal module including a heat sink and a fan connected to the heat sink;

a heat transfer member being arranged between the heat sink and the LED module, and having a heat-receiving face oriented to and bearing on the LED module and an opposite heat-transfer face oriented and connected to one side of the heat sink opposite to the fan; and a lamp holder having an end connected to one side of the fan opposite to the heat sink; the lamp shade being connected at the second open end to an outer periphery of the lamp holder; and the LED module, the thermal module and the heat transfer member being received in the hollow receiving space of the lamp shade.

2. The heat dissipation mechanism for LED lamp as claimed in claim 1, wherein the heat sink includes a main body and a plurality of radiating fins; the main body having a plurality of spaced mounting sections outward extended from an outer periphery of the main body; the radiating fins being outward extended from and spaced along the outer periphery of the main body to locate between adjacent mounting sections.

3. The heat dissipation mechanism for LED lamp as claimed in claim 2, wherein the mounting sections of the heat sink respectively have a free end, on which a through hole is formed for a corresponding fastening element to extend therethrough.

4. The heat dissipation mechanism for LED lamp as claimed in claim 3, wherein the fan includes a frame and a blade assembly mounted in the frame; the frame being provided at four corners with a plurality of mounting holes corresponding to the through holes on the heat sink.

5. The heat dissipation mechanism for LED lamp as claimed in claim 4, wherein the frame of the fan has an air-out side facing toward and connected to the heat sink, and an opposite air-in side connected to an end of the lamp holder.

6. The heat dissipation mechanism for LED lamp as claimed in claim 5, wherein the heat sink has a heat-absorption section and an opposite heat-dissipation section; the heat-absorption section being in tight contact with the heat-transfer face of the heat transfer member, and the heat-dissipation section being in tight contact with the air-out side of the fan.

7. The heat dissipation mechanism for LED lamp as claimed in claim 4, wherein the lamp holder has a third open end and a mounting section arranged in the third open end; the mounting section including a main body and a plurality of support arms outward extended from the main body to the third open end of the lamp holder, so that an opening is defined between any two adjacent supports, and the openings being communicable with the third open end.

8. The heat dissipation mechanism for LED lamp as claimed in claim 7, wherein a plurality of mounting holes is provided at joints of the support arms and the third open end of the lamp holder to correspond to the mounting holes on the frame of the fan and the through holes on the heat sink; and the fastening elements being sequentially extended through the through holes on the heat sink and the mounting holes on the fan into the mounting holes on the lamp holder.

9. The heat dissipation mechanism for LED lamp as claimed in claim 8, wherein the fastening elements are selected from the group consisting of screws and insertion pins.

10. The heat dissipation mechanism for LED lamp as claimed in claim 3, wherein the heat transfer member and the heat sink are connected to each other by way of welding.

11. The heat dissipation mechanism for LED lamp as claimed in claim 3, wherein the heat transfer member is a vapor chamber.

* * * * *